US005402164A

United States Patent [19]

Mutoh

[11] Patent Number: 5,402,164

[45] Date of Patent: Mar. 28, 1995

[54] INK JET RECORDING APPARATUS OF THE CONTINUOUS JET TYPE

[75] Inventor: Masayuki Mutoh, Machida, Japan

[73] Assignee: S.R. Technos Ltd., Tokyo, Japan

[21] Appl. No.: 784,719

[22] Filed: Oct. 30, 1991

[30] Foreign Application Priority Data

Nov. 5, 1990 [JP] Japan ..... 2-299203

[51] Int. Cl.[6] ..... B41J 2/02

[52] U.S. Cl. ..... 347/81; 347/19; 347/78

[58] Field of Search ..... 347/19, 74, 78, 79, 347/81

[56] References Cited

U.S. PATENT DOCUMENTS 4,048,639 9/1977 Walsh ..... 347/78
5,325,112 6/1994 Muto ..... 347/19

FOREIGN PATENT DOCUMENTS 4136402 5/1992 Germany ..... 347/78
21322 1/1990 Japan .
4-151251 5/1992 Japan ..... 347/78
2250476 6/1992 United Kingdom ..... 347/78
2265861 10/1993 United Kingdom ..... 347/78

*Primary Examiner*—R. L. Moses
*Attorney, Agent, or Firm*—Cushman Darby & Cushman

[57] ABSTRACT

An ink jet recording apparatus of the continuous jet type wherein the position of an ink jet jetting axis or nozzle axis can be detected readily with a simplified construction. The ink jet recording apparatus comprises test signal generating means which generates a controlling signal which varies continuously. Switch means selectively couples one of recording signal generating means and the test signal generating means to a controlling electrode of charging means provided for charging an ink drop. An electrically isolated conductive drop catcher catches an ink drop which has passed by separating means for forming an ink jet, and current detecting means detects electric charge carried to the conductive drop catcher by charged ink drops as an electric current. Relative position detecting means measures a relative positional relationship between an ink jet flying axis and the separating means from a controlling voltage outputted from the test signal generating means and an output of the current detecting means.

7 Claims, 9 Drawing Sheets

MPU
ND
R1
CP
EO
SWG
S/H
Vo
RESET
HOLD
SW4
SW3
SW2
C
Ij
OP
CD
HOLD
S/H TO MPU & SWG
HOLD
HOLD
RESET
TO CD
AD
IN
FF2
FF1
PSC
MAX/MIN
RC
LD
CK
CK
SG
D2
D1
R2
T
AC 100V

INK JET RECORDING APPARATUS OF THE CONTINUOUS JET TYPE

BACKGROUND OF THE INVENTION

1. Field of the Invention

This invention relates to an ink jet recording apparatus of the continuous jet type, and more particularly to adjustment of an ink jet jetting axis (nozzle axis) of a continuous jet type ink jet recording apparatus.

2. Description of the Prior Art

Various ink jet recording apparatus of the continuous jet type are conventionally known and practically used. An exemplary one of such conventional continuous jet type ink jet recording apparatus is shown in FIG. 9. Referring to FIG. 9, the continuous jet type ink jet recording apparatus shown includes an ink bottle 91 in which ink is accommodated, an ink pump 92 for applying a pressure to ink from the ink bottle 91 and sending out the thus pressurized ink, an ink tube 93 for supplying ink from the ink pump 92 therethrough, a nozzle 94 having a circular orifice of a very small diameter, an ink electrode 95 for holding the potential of ink in the nozzle 94 at a ground level, an oscillating element 96 in the form of a piezoelectric oscillating element mounted on the nozzle 94, an oscillating element driving oscillator 97 for applying an exciting signal to the oscillating element 96, a controlling electrode 98 having a circular opening or a slit-like opening coaxial with the nozzle 94 for receiving a controlling signal to control charging of a jet of ink, a grounding electrode 99 disposed in front of the controlling electrode 98 and grounded itself, a knife edge 100 mounted on the grounding electrode 99, a deflecting high voltage dc power source (hereinafter referred to as deflecting power source) 101, and a deflecting electrode 102 connected to the deflecting power source 101 for cooperating with the grounding electrode 99 to produce therebetween an intense electric field perpendicular to an ink jet flying axis to deflect a charged ink drop to the grounding electrode 99 side. The thus deflected charged ink drop is flown to a record medium 104 wrapped around a rotary drum 103.

In such conventional continuous jet type ink jet recording apparatus, ink pressurized by the ink pump 92 is introduced by way of the ink tube 93 into the nozzle 94, at which a jet of the ink is formed from the orifice. The ink jet is disintegrated into a train of ink drops with a spontaneous disintegrating frequency which depends upon a diameter and a flow rate of the ink jet and physical properties of the ink. In this instance, if the exciting frequency of the oscillating element 96 mounted on the nozzle 94 is set to a value at or around the spontaneous disintegrating frequency, then disintegration will be synchronized with excitation of the oscillating element 96, and consequently, ink drops of a very uniform size are produced with the exciting frequency.

If such uniform ink drop train is binary charge modulated in accordance with a controlling signal (recording pulses) having a phase synchronized with the exciting signal, then a charged ink drop will be deflected toward the grounding electrode 99 side by an action of the deflecting electric field produced by the deflecting electrode 102 and then cut by the knife edge 100, but an uncharged ink drop advances straightforwardly above the knife edge 100 to record a dot on the record medium 104 wrapped around the rotary drum 103. Accordingly, if the controlling signal is made correspond to a printing signal or an image signal, then a character or an image is recorded in a binary fashion on the record medium 104.

In order to control on-off of recording correctly and stably with a controlling signal or voltage supplied to the controlling electrode 98, it is necessary to provide a sufficient amount of deflection to an ink jet and to set the positional relationship between a jetting axis of the ink jet (nozzle axis) and the knife edge 100 to an optimum one.

The amount of deflection of an ink jet is designed, with a conventional continuous jet type ink jet recording apparatus which has been put into practical use, such that an ink jet is charge modulated with 40 to 150 volts and the amount of deflection above the knife edge 100 ranges from 0.1 to 0.4 mm.

In order to allow adjustment of the ink jet jetting axis (nozzle axis), a conventional continuous jet type ink jet recording apparatus which has been put into practical use has such a structure, for example, as shown in FIG. 10 wherein the nozzle 94 is normally urged by a compression Spring 112 upwardly in FIG. 10 to contact with an adjusting screw 113 so that it can be independently adjusted around a fulcrum 111 with respect to the knife edge 100 by means of the adjusting screw 113. Thus, the ink jet jetting axis (nozzle axis) is adjusted manually and mechanically.

The amount of deflection of an ink jet increases in proportion to a controlling voltage applied to the controlling electrode 98. Accordingly, the position of the ink jet jetting axis (nozzle axis) is optimum when an end of the knife edge 100 coincides with a medium point between ink jet flying axes that the ink jet presents when the controlling voltage is on and off. However, it is almost impossible to adjust, in a real machine, the ink jet jetting axis (nozzle axis) by observation of an ink jet flying axis by means of a microscope.

Actually, therefore, the continuous jet type ink jet recording apparatus is rendered operative to perform test printing while the adjusting screw 113 is operated manually to adjust the position of the nozzle 94.

Also an ink jet recording apparatus of the continuous jet type has been proposed and is disclosed, for example, in Japanese Patent Laid-Open Application No. 2-1322 wherein the amount of substantial deflection of an ink jet by a deflecting electric field when relative positions of such ink jet and a gutter member (which corresponds to or is equivalent to a knife edge) are to be set and adjusted is reduced (for example, to one half) from that when normal recording is performed. With such continuous jet type ink jet recording apparatus, a determination of whether or not an ink drop collides with the gutter member can be made readily by connecting a charge amount detector to the gutter member and monitoring an output of the charge amount detector.

With the conventional continuous jet type ink jet recording apparatus described first hereinabove, since actually it is rendered operative to perform test printing and the adjusting screw 113 is manually operated, during such test printing, to adjust the position of the ink jet jetting axis (nozzle axis), there is a problem that such adjustment is qualitative and identification of such medium point between ink jet flying axes as mentioned hereinabove is impossible. In particular, since an instant at which an ink jet collides with the knife edge 100 can be identified in the process of adjustment, it will be a limit in reduction to practice to presume a position of the nozzle 94 from a rotational angle of the adjusting screw 113 with reference to the position of the knife edge 100 then. If the adjusting screw 113 has some backlash, then identification of the medium point will be further inaccurate.

Further, since actually the adjusting screw 113 is manually operated to adjust the position of the nozzle 94 while the continuous jet type ink jet recording apparatus is operating, there is another problem that mechanical and electrical risks are involved.

Furthermore, since a record medium is consumed for adjustment of the position of the nozzle 94, there is a further problem that it is uneconomical.

In addition, it is also disadvantageous that, if an ink jet collides with an end of the knife edge 100 in a record area, then the rotary drum 103 or the like will become soiled.

On the other hand, with the second conventional continuous jet type ink jet recording apparatus wherein the amount of substantial deflection of an ink jet by a deflecting electric field when relative positions of an ink jet and a gutter member are to be set and adjusted is reduced from that when normal recording is performed, since the number of parameters of deflection upon adjustment is only one, there are drawbacks that it cannot be confirmed by what degree of accuracy the amount of deflection is adjusted, that precise adjustment is impossible if the mechanical accuracy is not high, that, if the mechanical accuracy is made high, then the continuous jet type ink jet recording apparatus will be high in production cost, and so forth. Especially, while the gutter member must have an insulating structure when a charge amount detector is connected to the gutter member, since the gutter member is always exposed to ink, there is a problem that much difficulty and complication in structure are involved in such insulating structure.

SUMMARY OF THE INVENTION

It is an object of the present invention to provide an ink jet recording apparatus of the continuous jet type wherein the position of an ink jet jetting axis or nozzle axis can be detected readily with a simplified construction.

In order to attain the object, according to the present invention, there is provided an ink jet recording apparatus of the continuous jet type, which comprises nozzle means for receiving pressurized ink and forming the received pressurized ink into a uniform ink jet which disintegrates into a train of ink drops, recording signal generating means for generating a controlling voltage in response to a recording signal, charging means including a controlling electrode at which a recording signal from the recording signal generating means is received for selectively charging an ink drop, deflecting means for forming a deflecting electric field perpendicular to an ink Jet flying axis to deflect a charged ink drop in a direction perpendicular to the ink jet flying axis, separating means for cutting a deflected ink drop but allowing a non-deflected ink drop to pass thereby, test signal generating means for generating a controlling signal which varies continuously, switch means for selectively coupling one of the recording signal generating means and the test signal generating means to the controlling electrode of the charging means, an electrically isolated conductive drop catcher for catching an ink drop which has passed by the separating means, current detecting means connected to the conductive drop catcher for detecting electric charge carried to the conductive drop catcher by charged ink drops as an electric current, and relative position detecting means for measuring a relative positional relationship between the ink jet flying axis and the separating means from a controlling voltage outputted from the test signal generating means and an output of the current detecting means.

In the ink jet recording apparatus of the continuous jet type, the test signal generating means generates a controlling signal which varies continuously, and the switch means selectively couples one of the recording signal generating means and the test signal generating means to the controlling electrode of the charging means. Then, the electrically isolated conductive drop catcher catches an ink drop which has passed by the separating means, and the current detecting means detects electric charge carried to the conductive drop catcher by charged ink drops as an electric current. The relative position detecting means thus measures a relative positional relationship between the ink jet flying axis and the separating means from a controlling voltage outputted from the test signal generating means and an output of the current detecting means.

With the ink jet recording apparatus of the continuous jet type, since the position of the ink jet jetting axis (nozzle axis) is automatically measured using a controlling voltage which varies continuously, identification of a medium point between ink jet flying axes provided when such controlling voltage presents its minimum and maximum values can be performed quantitatively and readily, and consequently, the position of the ink jet jetting axis, that is, an axis of the nozzle means, can be adjusted accurately. Further, since such adjustment of the ink jet jetting axis (nozzle axis) can be performed while a rotary drum on which a record medium is carried or a carriage on which the nozzle means is carried is in a stopping condition, no mechanical nor electrical risk is involved in such adjustment. Besides, since such adjustment can be performed in a region in which recording does not take place such as, for example, at a home position of the carriage or the like, there is no necessity of performing test printing using a record medium, which is economical, and besides a recording area will not be soiled by ink mist.

Further, with the ink jet recording apparatus of the continuous jet type, when it is compared with such a conventional ink jet recording apparatus of the continuous jet type as described hereinabove wherein the amount of substantial deflection of an ink jet when relative positions of such ink jet and a gutter member are to be set and adjusted is reduced from that when normal recording is performed, since the amount of deflection upon adjustment varies continuously, it is possible to identify by what degree of accuracy the adjustment is made. Consequently, such adjustment can be performed readily without any improvement in mechanical accuracy. Particularly, since the current detector is connected to the conductive drop catcher to effect detecting of a jet current, a knife edge need not be constructed in an insulating structure, and consequently, the ink jet recording apparatus of the continuous jet type can be produced readily.

The above and other objects, features and advantages of the present invention will become apparent from the following description and the appended claims, taken in conjunction with the accompanying drawings in which like parts or elements are denoted by like reference characters.

DESCRIPTION OF THE PREFERRED EMBODIMENTS

Figure 1:
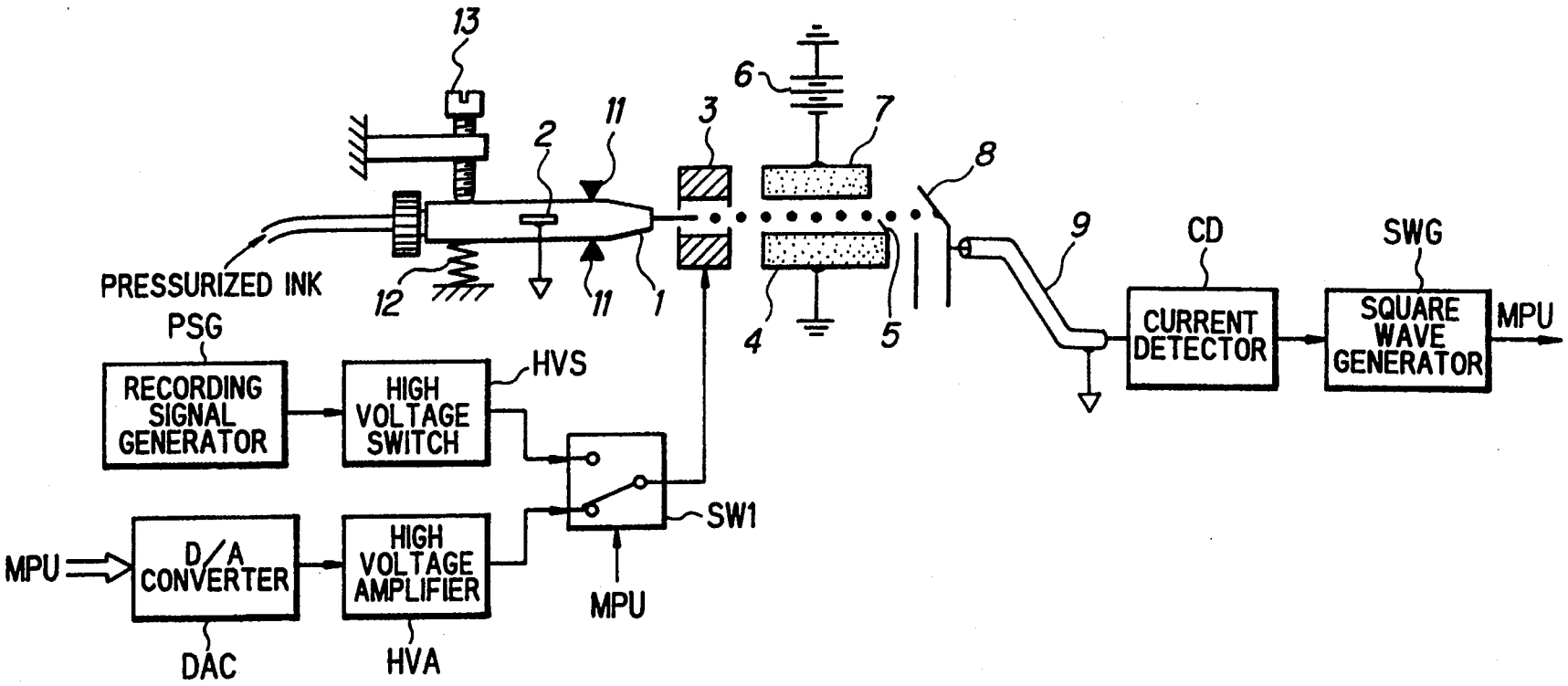
FIG. 1 is a diagrammatic representation of a continuous jet type ink jet recording apparatus showing a first preferred embodiment of the present invention.

Referring first to FIG. 1, there is shown an ink jet recording apparatus of the continuous jet type to which the present invention is applied. The continuous jet type ink jet recording apparatus of the present embodiment includes a nozzle 1 having an orifice having a very small diameter, an ink electrode 2 for holding the potential of ink in the nozzle 1 at a ground level, a controlling electrode 3 having a circular opening or a slit-like opening coaxial with the nozzle 1 and receiving a controlling signal to control charging of a jet of ink passing the opening therein, a grounding electrode 4 disposed in front of the controlling electrode 3 and grounded itself, a knife edge 5 mounted on the grounding electrode 4, a deflecting high voltage dc power source (hereinafter referred to as deflecting power source) 6, a deflecting electrode 7 connected to the deflecting power source 6 for cooperating with the grounding electrode 4 to produce therebetween an intense electric field perpendicular to an ink jet flying axis to deflect a charged ink drop to the grounding electrode 4 side, a conductive drop catcher 8 disposed at a home position of a carriage (not shown), on which the nozzle 1 is carried in front of the grounding electrode 4 and the deflecting electrode 7 and serving also as a detecting electrode, a shielding line 9 connected to the conductive drop catcher 8, a fulcrum 11 for the nozzle 1, an adjusting screw 13 for adjusting the position of the nozzle 1 (inclination of an axis of the nozzle 1), a compression spring 12 for urging the nozzle 1 to contact with the adjusting screw 13 to allow adjustment of the nozzle 1 by the adjusting screw 13, a recording signal generator PSG, a high voltage switch HVS to which the recording signal generator PSG is connected, a digital to analog (D/A) converter DAC connected to a microprocessor (MPU) not shown which serves as controlling means, a high voltage amplifier HVA connected to the digital to analog converter DAC, a switch SW1 for selectively connecting one of the high voltage switch HVS and the high voltage amplifier HVA to the controlling electrode 3 in response to an instruction signal from the MPU, a current detector CD connected to the shielding line 9, and a square wave generator SWG for generating a square wave in response to an output of the current detector CD and outputting the thus generated square wave to the MPU.

In order to adjust the ink jet jetting axis (nozzle axis) with the continuous Jet type ink jet recording apparatus of the construction described above, rotation of a rotary drum (not shown) around which a record medium is removably wrapped is stopped first, and the carriage is moved to and stopped at the home position. Then, ink is pressurized by means of an ink pump not shown and introduced by way of an ink tube not shown into the nozzle 1 so that a jet of the ink is jetted from the nozzle 1. The continuous jet type ink jet recording apparatus is thus maintained in a normal condition. On the other hand, an oscillating element (not shown) mounted on the nozzle 1 is excited by an oscillation frequency equal to or around a spontaneous disintegrating frequency of an ink jet. Consequently, the ink jet jetted from the nozzle 1 is disintegrated in synchronism with excitation of the oscillating element.

In this condition, the MPU which serves as controlling means first changes over the switch SW1 to connect the high voltage amplifier HVA to the controlling electrode 3. It is to be noted that, during normal recording, the switch SW1 assumes another position at which the high voltage switch HVS is connected to the controlling electrode 3.

Figure 2:
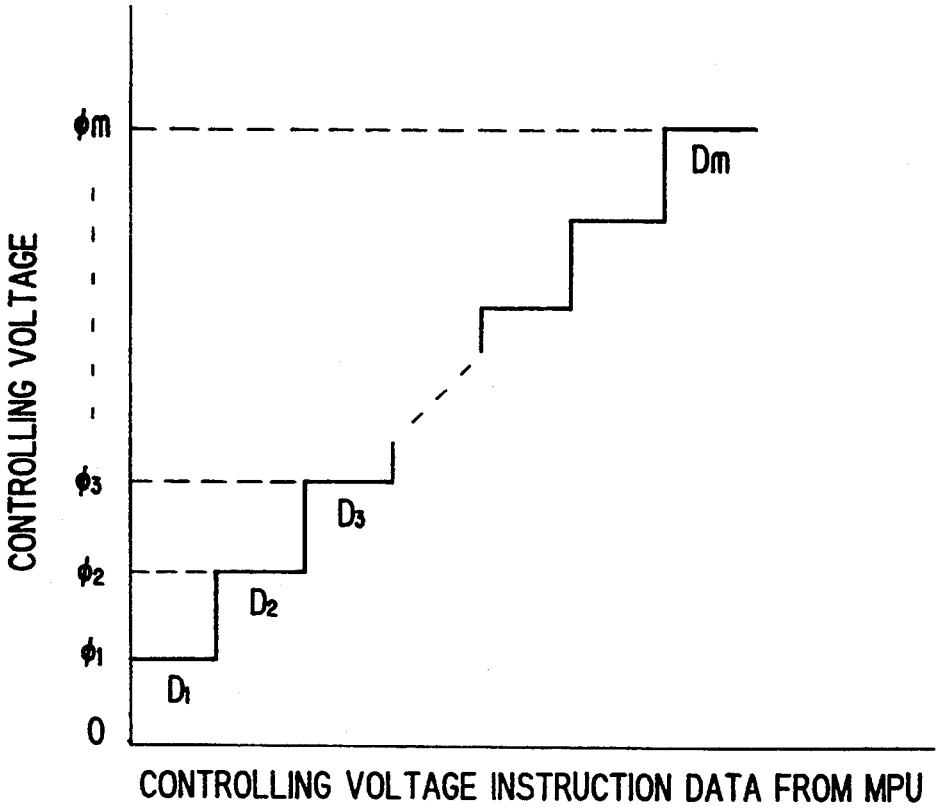
FIG. 2 is a graph showing a relationship between controlling voltage instruction data from an MPU of the continuous jet type ink jet recording apparatus of FIG. 1 and a controlling voltage.
Figure 3:
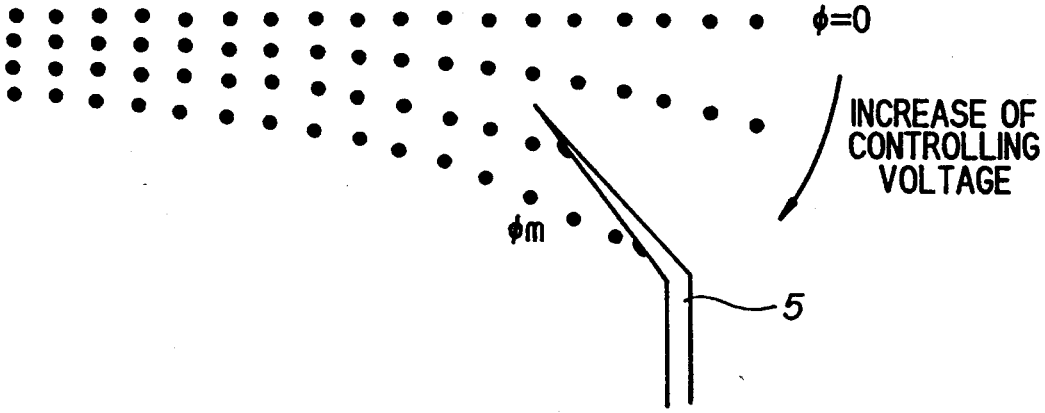
FIG. 3 is an illustration showing a relationship between a knife edge and a controlling voltage in the continuous jet type ink jet recording apparatus of FIG. 1.

Subsequently, the MPU successively outputs controlling voltage instruction data $D_1$ to $D_m$, which gradually increase (or decrease) in value in such a stepwise condition as shown in FIG. 2, to the digital to analog converter DAC while successively checking an output of the square wave generator SWG to detect an inversion of such output. In particular, outputting of controlling voltage instruction data and checking of an output of the square wave generator SWG to detect an inversion of such output are repetitively and successively performed such that controlling voltage instruction data $D_1$ are outputted and the output of the square wave generator SWG is checked, and then controlling voltage instruction data $D_2$ are outputted and the output of the square wave generator SWG is checked, and the like until an inversion of the output of the square wave generator SWG is detected with certain controlling voltage instruction data $D_k$ ($1<k<m$). Thus, a controlling voltage $\phi_k$ at which an ink jet is cut by an end of the knife edge 5 is determined from the controlling voltage instruction data $D_k$ then. Since the amount of deflection of a charged ink drop increases substantially in proportion to the controlling voltage $\phi_k$, the MPU quantitatively detects relative positions of an ink jet flying axis and the knife edge 5 from the controlling voltage $\phi_k$.

The digital to analog converter DAC successively converts such controlling voltage instruction data $D_1$ to $D_m$ into analog voltages, and the analog voltages thus obtained are successively high voltage amplified by the high voltage amplifier HVA and applied as controlling voltages $\phi_1$ to $\phi_m$ to the controlling electrode 3 by way of the switch SW1. Consequently, the ink jet is successively induction charged with the controlling voltages $\phi_1$ to $\phi_m$. The amount of deflection of the thus charged ink jet increases as the controlling voltage increases from $\phi_1$ to $\phi_m$, and at a certain controlling voltage $\phi_k$, the ink jet will first be cut by the knife edge 5. (Or on the contrary, the amount of deflection decreases as the controlling voltage decreases from $\phi_m$ to $\phi_1$, and the ink jet will first be cut by the knife edge 5 at a certain controlling voltage $\phi_k$.) Thus, the controlling voltage $\phi_k$ at which the ink jet is cut by the end of the knife edge 5 can be determined from the controlling voltage instruction data $D_k$ then.

Subsequently, the MPU judges the adjusted position of the nozzle 1 from the controlling voltage $\phi_k$ and controls a display device or the like (not shown), which belongs to the continuous jet type ink jet recording apparatus, to provide a display of such adjusted position. In particular, when the controlling voltage $\phi_k$ is lower than one half the controlling voltage $\phi_m$ for recording, the MPU determines that the ink jet jetting axis (nozzle axis) is inclined relative to the knife edge 5 below a medium point between an ink jet flying axis provided when the controlling voltage is 0 volt and another ink jet flying axis provided when the controlling voltage is equal to the controlling voltage of $\phi_m$ volts for recording and controls the display device to provide a display of instructing upward adjustment of the nozzle 1 (for example, the display of "UP"). On the contrary when the controlling voltage $\phi_k$ is higher than one half the controlling voltage $\phi_m$ for recording, the MPU judges that the ink jet jetting axis (nozzle axis) is inclined relative to the knife edge 5 above the medium point between the ink jet flying axis provided when the controlling voltage is 0 volt and the other ink jet flying axis provided when the controlling voltage is equal to the control voltage of $\phi_m$ volts for recording and controls the display device to provide a display of instructing downward adjustment of the nozzle 1 (for example, the display of "DOWN"). On the other hand, when the controlling voltage $\phi_k$ is substantially equal to one half the controlling voltage $\phi_m$, for recording, the MPU judges that the ink jet jetting axis (nozzle axis) is adjusted relative to the knife edge 5 to or around the medium point between the ink jet flying axis provided when the controlling voltage is 0 volt and the other ink jet flying axis provided when the controlling voltage is equal to the control voltage of $\phi_m$ volts for recording and controls the display device to provide a display that adjustment of the nozzle 1 is completed (for example, the display of "OK").

An operator who intends to adjust the ink jet jetting axis (nozzle axis) will thus manually operate the adjusting screw 13 while observing the display on the display device or the like of the continuous jet type ink jet recording apparatus to set the nozzle 1 for a short period of time to an optimum position at which the end of the knife edge 5 is positioned at the medium position at which an angle between the ink jet flying axes when the controlling voltage is 0 volt and $\phi_m$ volts for recording is divided accurately into two. In other words, the nozzle 1 can be adjusted so that the ink jet flying axis is positioned to the end of the knife edge 5 at the controlling voltage $\phi_m/2$ equal to one half the controlling voltage $\phi_m$ for recording.

Then, when a display that adjustment of the nozzle 1 is completed is provided on the display device or the like, it is determined that the adjustment is completed.

By the way, in the continuous jet type ink jet recording apparatus of the present embodiment, the current detector CD must be able to measure a very low jet current (10 to 100 nA). For example, if it is assumed that the controlling voltage $\phi_1$ is equal to $\phi_1=\phi_m/10$ and the controlling voltage varies from $\phi_1$ to $\phi_m$, an electric current produced by charged ink drops ranges 1 to 100 nA. Accordingly, such low current must necessarily be measured with a high S/N ratio.

Figure 4:
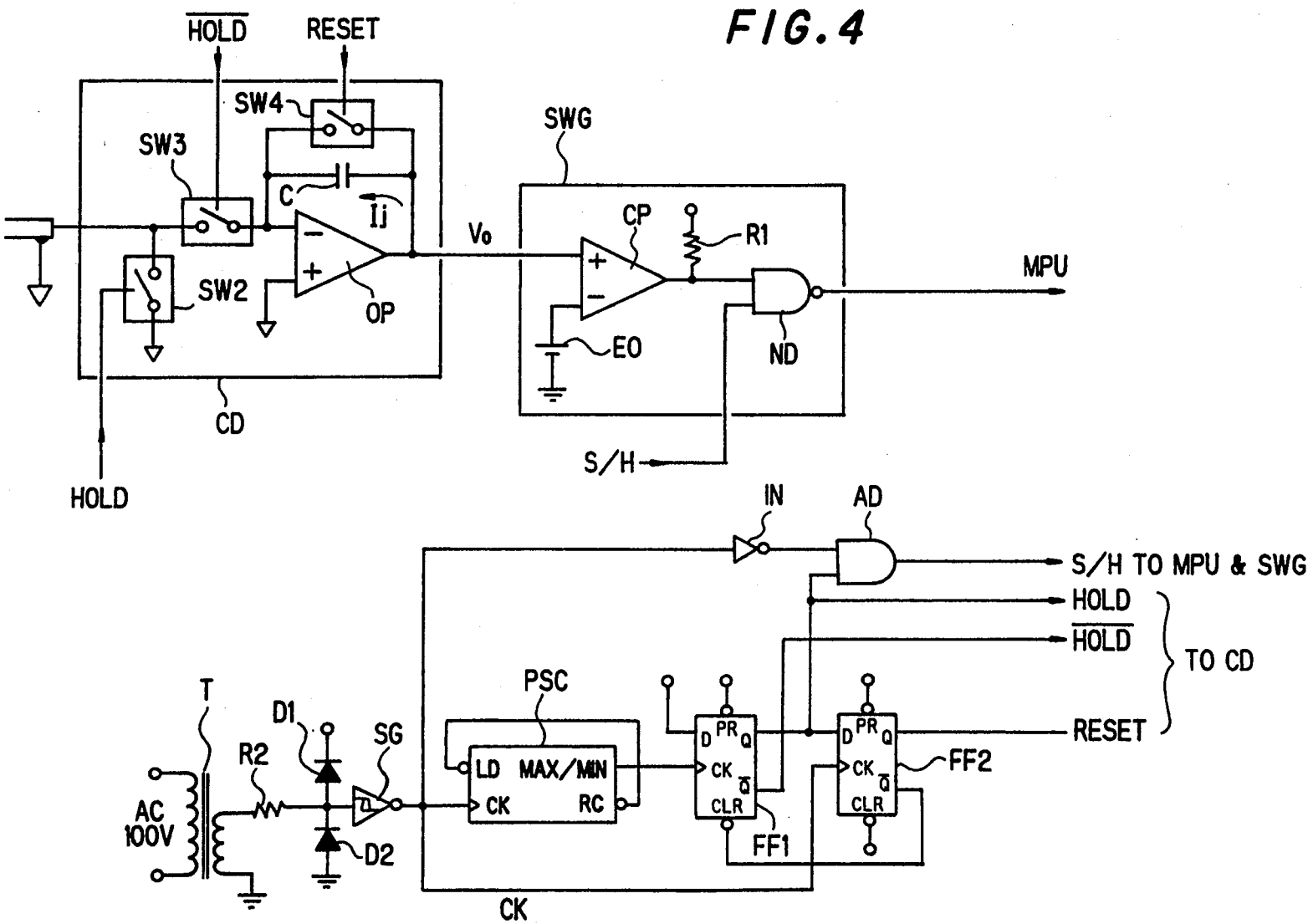
FIG. 4 is a circuit diagram showing a current detector, a square wave generator and a synchronizing signal generating circuit suitably employed in the continuous jet type ink jet recording apparatus of FIG. 1.

Referring now to FIG. 4, the current detector CD and square wave generator SWG of the continuous jet type ink jet recording apparatus shown in FIG. 1 are shown together with a circuit which is used suitably as a synchronizing signal generating circuit together with them. The current detector CD includes an integrating capacitor C, an integrator OP for which an operational amplifier having an input stage constituted from an FET (field effect transistor) is employed, and three switches SW2, SW3 and SW4 constituted from FETs which operate in synchronism with a frequency of an available commercial ac power of, for example, 100 volts.

Meanwhile, the square wave generator SWG includes a comparator CP, a reference power source EO, a resistor R1 and a NAND gate ND.

Further, the synchronizing signal generating circuit includes a transformer T, a resistor R2, a pair of diodes D1 and D2, a Schmitt trigger gate SG, a presettable counter PSC, a pair of delay type flip-flops FF1 and FF2, an inverter IN and an AND gate AD.

The presettable counter PSC can be set with a variable preset value by way of a route not shown so that an integrating time can be varied with a period of the commercial ac power multiplied by an integral number. If the integrating time is increased, then the S/N ratio is improved naturally. In the present embodiment, the integrating time is set to three times the period of the commercial ac power as seen from a timing chart of FIG. 5.

A reset signal RESET, an integration starting signal $\overline{\text{HOLD}}$ and an integration ending signal HOLD to be supplied to the current detector CD are fixed to one period of the commercial ac power, and when they present a high ("H") level, they close the switches SW4, SW3 and SW2, respectively, but on the contrary when they present a low ("L") level, they open the switches SW4, SW3 and SW2, respectively. Meanwhile, a sample holding signal S/H is outputted from the synchronizing signal generating circuit in synchronism with the latter half of a hold period when the integration ending signal HOLD presents the "H" level, and is delivered to one of a pair of input terminals of the NAND gate ND of the square wave generator SWG and also to the MPU.

Figure 5:
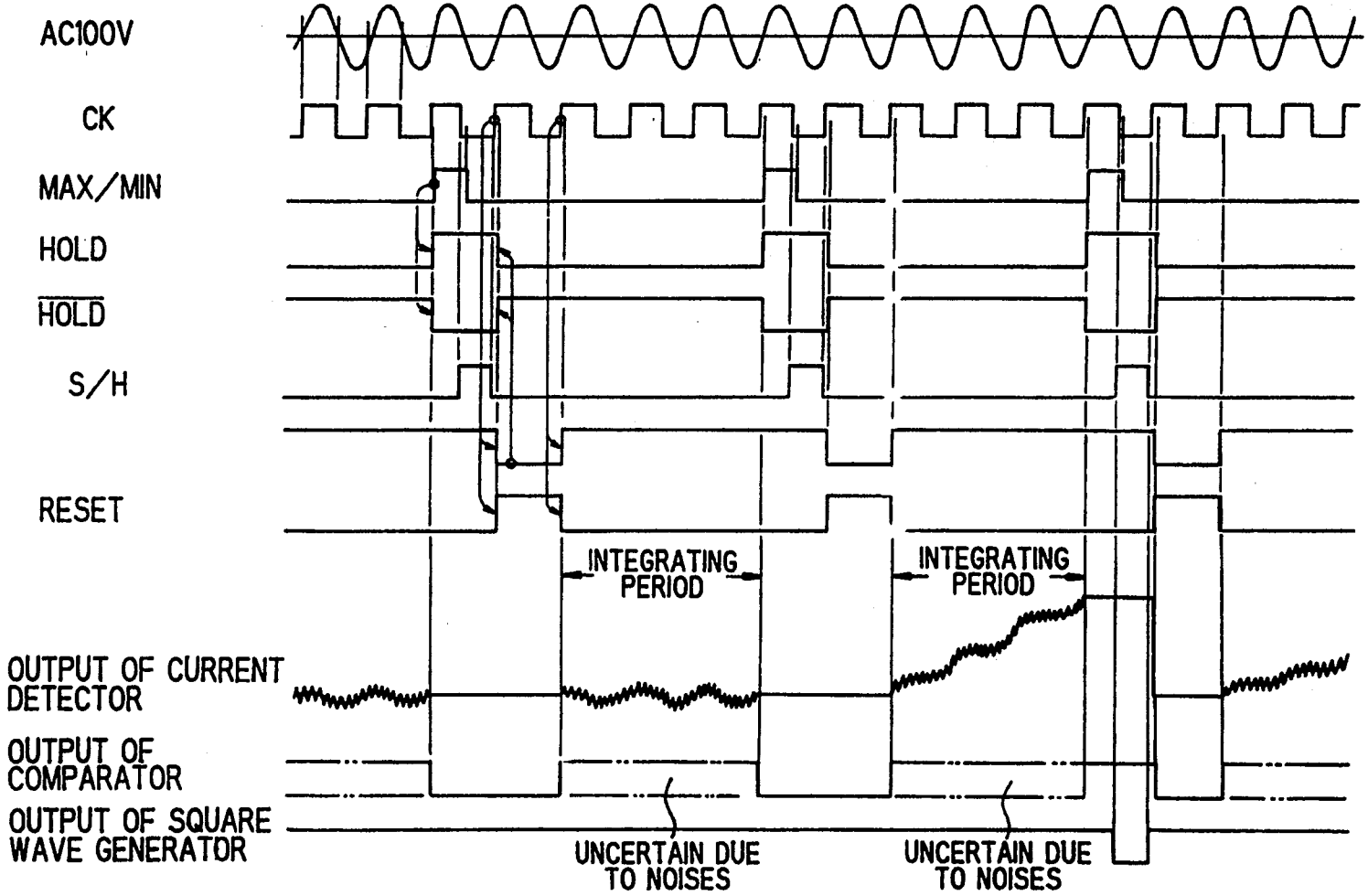
FIG. 5 is a timing charge illustrating operation of the current detector, square generator and synchronizing signal generating circuit shown in FIG. 4.

In the synchronizing signal generating circuit, the voltage of 100 volts of of the commercial ac power is dropped by the transformer T, and an output of the transformer T is clamped at 0 V and 5 V by the diodes D1 and D2. Then, a clock signal CK of a TTL (transistor-transistor logic) level synchronized with the commercial ac power is produced from the thus clamped voltage. Then, from the clock signal CK, such integration starting signal $\overline{\text{HOLD}}$, integration ending signal HOLD, reset signal RESET and sample holding signal S/H as shown in the timing chart of FIG. 5 are produced by means of the presettable counter PSC, two flip-flops FF1 and FF2, inverter IN and AND gate AD.

When the reset signal RESET changes from the "L" to the "H" level, the switch SW4 is changed over into a closed condition so that the integrating capacitor C is short-circuited. Consequently, the output of the integrator OP is reset to 0 volt.

When the reset signal RESET changes from the "H" to the "L" level after one period of the commercial ac power, the switch SW4 is changed over to an open condition. Since the integration ending signal HOLD is at the "L" level (the switch SW2 is open) and the integration starting signal $\overline{HOLD}$ is at the "H" level (the switch SW3 is closed) then, a jet current $I_j$ flows into an imaginary grounded point of the operational amplifier constituting the integrator OP, thereby starting integration by the integrator OP.

Since an ink jet is charged by a controlling signal applied to the controlling electrode 3 so that it may have a negative charge, the jet current $I_j$ flows in the direction indicated by an arrow mark in FIG. 4 through the integrating capacitor C, and consequently, the integrator OP provides a positive output voltage $V_0$.

After an interval of time equal to one period of the commercial ac power multiplied by an integral number (three in the case shown in FIG. 5) passes after starting of such Integration, the integration ending signal HOLD is changed over to the "H" level (the switch SW2 is closed) and the integrating starting signal $\overline{HOLD}$ is changed over the "L" level (the switch SW3 is opened), and consequently, the jet current $I_j$ is interrupted. As a result, the let current $I_j$ which has been integrated into the integrating capacitor C till then is held as an output voltage $V_0$ of the integrator OP. The output voltage $V_0$ held by the integrator OP is compared with the reference power source E0 by the comparator CP of the square wave generator SWG, and if $V_0 > E0$, then the output of the comparator CP presents the "H" level, which is supplied to the HAND circuit ND. Consequently, if the sample holding signal S/H is at the "H" level, then the HAND gate ND is changed over to the "L" level, which is inputted to the MPU.

By the way, in an actual machine, it is almost impossible to perfectly shield the circuit composed of various elements from the conductive drop catcher 8 to the integrator OP from noises. Therefore, during an integrating operation, noises of the commercial ac power and some other high frequency noises generated from some other electronic appliances around the continuous jet type ink jet recording apparatus are included in an overlapping relationship in the output of the integrator OP. Among such noises, the high frequency noises are averaged and do not matter because the integrating time is longer than one period of the commercial ac power and hence sufficiently long. Further, since the integrating time of the jet current $I_j$ by the present current detector CD is set equal to a period of the commercial ac power multiplied by an integral number, also noises of the commercial-ac power are averaged for the integrating period and accordingly are removed automatically.

Meanwhile, the comparator CP in the square wave generator SWG normally remains in an operative condition and hence operates even during an integrating operation of the integrator OP in which such noises as mentioned above are included in an overlapping condition (operation in error). In order to remove such noises, an output of the comparator CP is connected to one of a pair of input terminals of the NAND gate ND so that it may be outputted in synchronism with the sample holding signal S/H which is produced in the latter half of a holding period of the output voltage $V_0$ of the integrator OP. Also, the MPU fetches an output of the square wave generator SWG in synchronism with the sample holding signal S/H.

Further, when the integrating operation of the jet current $I_j$ comes to an end, the integration starting signal $\overline{HOLD}$ is changed over to the "L" level to open the switch SW3, and consequently, the jet current $I_j$ is interrupted and also noises which may be introduced into the integrator OP from the input side are interrupted. Accordingly, at a time at which the MPU reads out an output of the square wave generator SWG, the output of the integrator OP is free from noises, and consequently, the jet current $I_j$ is read out correctly. Therefore, if only the integrator OP is shielded sufficiently, then only noises produced in the integrator OP will be included in the output of the integrator OP, and consequently, the jet current $I_j$ can be measured with a very high degree of accuracy. In this manner, current detecting means of a high performance can be constructed with simple and inexpensive elements.

Now, where the jet current is $I_j$ (amperes), the capacitance of the integrating capacitor C is C (farads) and the integrating time is T (seconds), the output $V_0$ (volts) of the integrator OP is given by $V_0 = I_j\ T/C$. When, for example, $I_j = 10^{-9}$ ampere (1 nA), if the capacitance C of the integrating capacitor C and the integrating time T are set to $C = 10^{-9}$ farad (1,000 pF) and $T = 0.1$ second which may be five periods of the AC 100 volts, respectively, then the output voltage $V_0$ of the integrator OP is $V_0 = 0.1$ volt (100 mV). Thus, the circuit can be practically used sufficiently.

Figure 6:
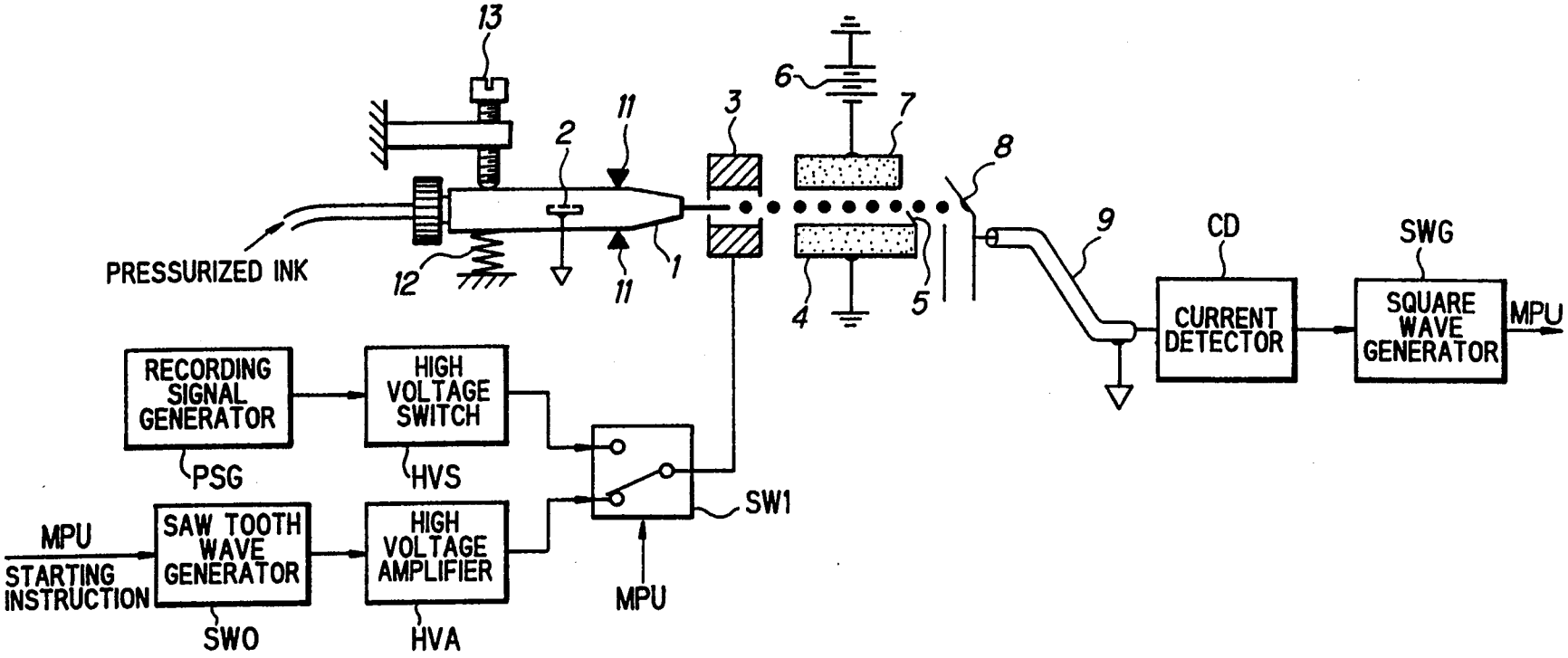
FIG. 6 is a diagrammatic representation of another continuous jet type ink jet recording apparatus showing a second preferred embodiment of the present invention.
Figure 7:
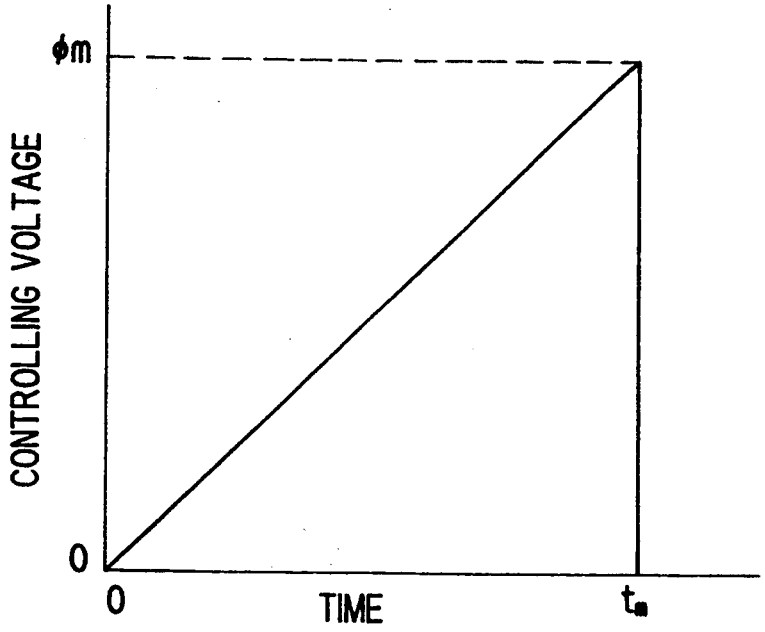
FIG. 7 is a graph showing a relationship between a time and a controlling voltage outputted from a saw tooth wave generator of the continuous jet type ink jet recording apparatus of FIG. 6.

Referring now to FIG. 6, there is shown another ink jet recording apparatus of the continuous jet type to which the present invention is applied. The continuous jet type ink Jet recording apparatus of the present embodiment is a modification to the continuous jet type ink jet recording apparatus of the preceding embodiment shown in FIG. 1 but is different only in that, while the test signal generating means of the continuous jet type ink jet recording apparatus of the first embodiment is constituted from the digital to analog converter DAC and the high voltage amplifier HVA, the test signal generating means of the continuous jet type ink jet recording apparatus of the present embodiment is constituted from a saw tooth wave generator SWO and a high voltage amplifier HVA. The saw tooth wave generator SWO starts oscillation thereof in response to a starting instruction from the MPU and generates such a saw tooth wave as shown in FIG. 7 wherein it rises at such a rate that a controlling voltage thereof presents $\phi_m$ at a time after lapse of an interval of time $t_m$ after the starting of oscillation. For example, in case the current detecting means includes such current detector DC ($C = 10^{-9}$ F, $T = 0.1$ sec) of the continuous jet type ink jet recording apparatus of the first embodiment, it is desirable to set the saw tooth wave generator SWO so as to satisfy the relationship $t_m > 10\ T$ (1 sec) in order to achieve time division sampling.

In operation, the MPU outputs a starting instruction to the saw tooth wave generator SWO at the time $t = 0$ to start checking of an output of the square wave generator SWG to detect the "L" level. Then, when an "L"

level output from the square wave generator SWG is detected at the time $t=t_k$, the MPU calculates a controlling voltage $\phi_k$ then in accordance with the expression $\phi_k=\phi_m\ t_k/t_m$ using a proportional relationship between them. If the controlling voltage $\phi_k$ is found out, then this means that the relative positional relationship between the ink jet flying axis and the knife edge 5 is determined quantitatively. Therefore, after then, adjustment of the ink jet jetting axis will be performed in a similar manner as with the continuous jet type ink jet recording apparatus of the first embodiment.

Figure 8:
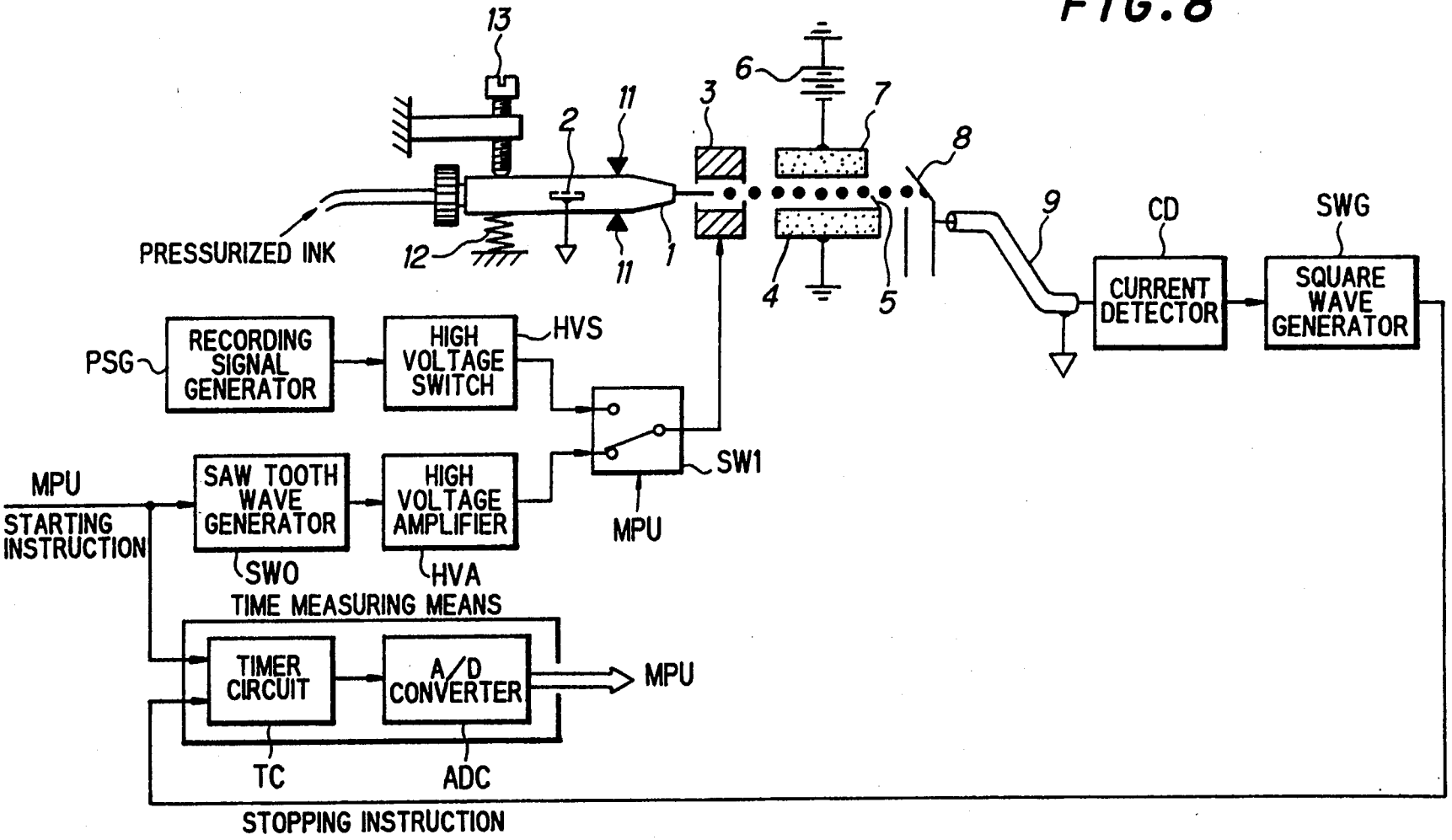
FIG. 8 is a diagrammatic representation of a further continuous jet type ink jet recording apparatus showing a third preferred embodiment of the present invention.
Figure 9:
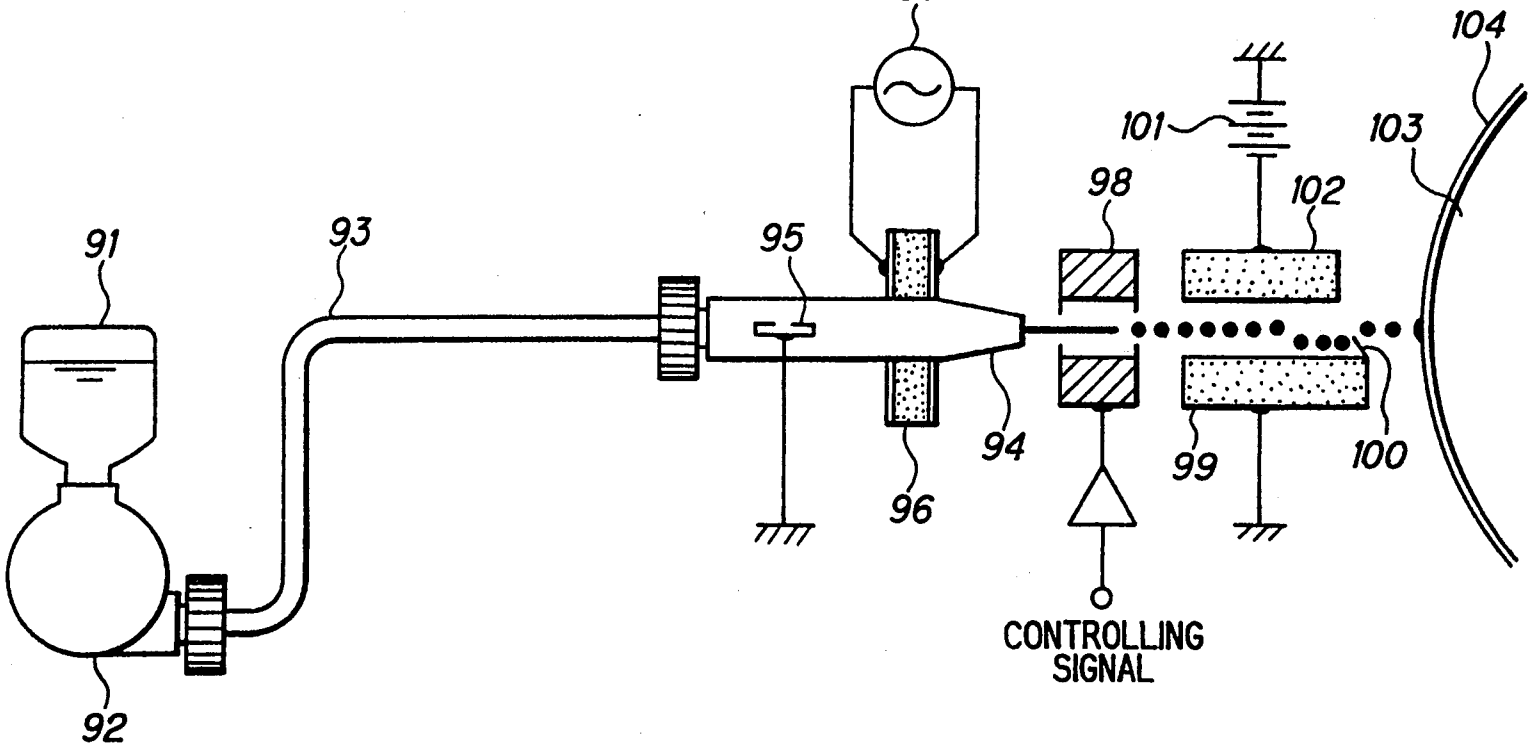
FIG. 9 PRIOR ART
FIG. 9 is a diagrammatic representation of an exemplary one of conventional continuous jet type ink jet recording apparatus.
Figure 10:
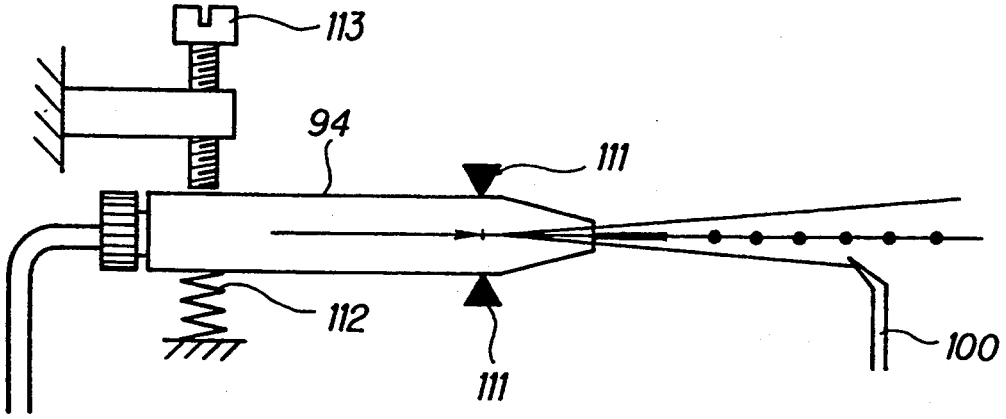
FIG. 10 PRIOR ART
FIG. 10 is an adjusting mechanism for a nozzle of the continuous jet type ink jet recording apparatus of FIG. 9.

Referring now to FIG. 8, there is shown a further ink jet recording apparatus of the continuous jet type to which the present invention is applied. The continuous jet type ink jet recording apparatus of the present embodiment is a modification to the continuous jet type ink jet recording apparatus of the second embodiment shown in FIG. 6 in that it additionally includes time measuring means as a hardware element. In particular, while a built-in timer of the MPU is employed as time measuring means in the continuous jet type ink jet recording apparatus of the second embodiment shown in FIG. 6, in the continuous jet type ink jet recording apparatus of the present embodiment, time measuring means including a timer circuit TC and an analog to digital (A/D) converter ADC is provided separately from the MPU in order to reduce the load to the MPU.

In the continuous Jet type ink jet recording apparatus of the third embodiment having such construction as described just above, the timer circuit TC starts its time counting operation when a starting instruction is received from the MPU, and when an inverted output from the square wave generating circuit SWG is received as a stopping instruction, it stops its time counting operation. Then, the thus counted time of the timer circuit TC is once converted into digital data by the analog to digital converter ADC and then outputted to the MPU. In response to such data, the MPU determines a controlling voltage $\phi_k$ then and quantitatively detects a relative positional relationship between the ink jet flying axis and the knife edge 5.

Accordingly, with the continuous jet type ink jet recording apparatus of the third embodiment, similar effects to those of the continuous jet type ink jet recording apparatus of the second embodiment are attained naturally.

Further, though not specifically shown, if an output of an astable multivibrator, which oscillates at a fixed frequency, is inputted to a clock input of an adding counter by way of s gate which is opened in response to a starting instruction from the MPU but is closed in response to a stopping instruction from the square wave generating circuit SWG, then an output of the adding counter can be used as it is as an output of time measuring means.

Having now fully described the invention, it will be apparent to one of ordinary skill in the art that many changes and modifications can be made thereto without departing from the spirit and scope of the invention as set forth herein.

What is claimed is:

1. An ink jet recording apparatus of the continuous jet type, comprising:

nozzle means for receiving pressurized ink and forming the received pressurized ink into a uniform ink jet which disintegrates into a train of ink drops;

recording signal generating means for generating a controlling voltage in response to s recording signal;

charging means including a controlling electrode at which a recording signal from said recording signal generating means is received for selectively charging an ink drop;

deflecting means for forming a deflecting electric field perpendicular to an ink jet flying axis to deflect a charged ink drop in a direction perpendicular to the ink jet flying axis;

separating means for cutting a deflected ink drop but allowing s non-deflected ink drop to pass thereby;

test signal generating means for generating a controlling signal which varies continuously;

switch means for selectively coupling one of said recording signal generating means and said test signal generating means to said controlling electrode of said charging means;

an electrically isolated conductive drop catcher for catching an ink drop which has passed by said separating means;

current detecting means connected to said conductive drop catcher for detecting electric charge carried to said conductive drop catcher by charged ink drops as an electric current; and relative position detecting means for measuring a relative positional relationship between the ink jet flying axis and said separating means from a controlling voltage outputted from said test signal generating means and an output of said current detecting means.

2. An ink jet recording apparatus of the continuous jet type as claimed in claim 1, wherein said test signal generating means includes a digital to analog converter and a high voltage amplifier.

3. An ink jet recording apparatus of the continuous jet type as claimed in claim 1, wherein said test signal generating means includes a saw tooth wave generator and a high voltage amplifier.

4. An ink jet recording apparatus of the continuous jet type as claimed in claim 3, further comprising time measuring means for measuring an interval of time after said saw tooth wave generator starts oscillation until said current detecting means develops an output.

5. An ink jet recording apparatus of the continuous jet type as claimed in claim 10 wherein said current detecting means includes an integrating circuit which operates in synchronism with a frequency of a commercial ac power.

6. An ink jet recording apparatus of the continuous jet type as claimed in claim 5, wherein said relative position detecting means includes a comparator for comparing an output of said current detecting means with a reference signal, and a gate for inhibiting passage of an output of said comparator therethrough when said integrating circuit is in an operative condition.

7. An ink jet recording apparatus of the continuous jet type as claimed in claim 1, wherein said test signal generating means generates a controlling signal which varies in a continuous but stepwise manner.

* * * * *